US007670098B2

(12) United States Patent
Caughern

(10) Patent No.: US 7,670,098 B2
(45) Date of Patent: Mar. 2, 2010

(54) MACHINE TO UNLOAD TIES OFF OF RAILROAD CARS

(76) Inventor: Ray Caughern, P.O. Box 774, Heavener, OK (US) 74937

( * ) Notice: Subject to any disclaimer, the term of this patent is extended or adjusted under 35 U.S.C. 154(b) by 114 days.

(21) Appl. No.: 11/421,640

(22) Filed: Jun. 1, 2006

(65) Prior Publication Data

US 2007/0280811 A1 Dec. 6, 2007

(51) Int. Cl.
*B66C 1/00* (2006.01)

(52) U.S. Cl. ..... 414/680; 37/411; 294/68.23

(58) Field of Classification Search ..... 414/680, 414/685, 722, 729, 735; 294/68.23; 37/403, 37/406, 411

See application file for complete search history.

(56) References Cited

U.S. PATENT DOCUMENTS 3,263,834 A 8/1966 La Tendresse
4,096,954 A 6/1978 Buckner
4,102,528 A 7/1978 Cripe
4,128,180 A 12/1978 Mellious
4,175,902 A 11/1979 Herzog et al.
4,190,394 A 2/1980 Herzog et al.
4,411,585 A 10/1983 Quinn
4,517,755 A * 5/1985 Nicholson ..... 37/404
4,648,782 A * 3/1987 Kraft ..... 414/735
4,692,089 A 9/1987 Rodgers et al.
4,830,562 A 5/1989 Frederking
5,219,265 A 6/1993 Recker
5,518,359 A 5/1996 Pratt
5,527,144 A 6/1996 Herzog et al.
5,564,885 A 10/1996 Staben, Jr.
5,628,606 A 5/1997 Herzog et al.
6,089,162 A 7/2000 Madison
6,267,547 B1 7/2001 Lund
6,561,742 B1 5/2003 Crawford et al.
6,742,291 B2 * 6/2004 Frigon et al. ..... 37/406

OTHER PUBLICATIONS

Herzog Railroad Services web page @ www.herzogcompanies.com/rrservices/index/php.

* cited by examiner

*Primary Examiner*—Donald Underwood
(74) *Attorney, Agent, or Firm*—Crowe & Dunlevy

(57) ABSTRACT

An attachment used in conjunction with a backhoe or track hoe to convert it into a machine to unload ties off of railroad cars. Two pins on an upper end of the attachment secure it to the distal end of the working arm of the backhoe or track hoe so that a front edge of the attachment point toward the backhoe or track hoe. Upper ends of four c-shaped members attached to an upper plate on the upper end of the attachment. Opposite lower ends of each of the four spaced apart c-shaped members are flattened on upper and lower surfaces into a point. A lower plate is secured to the upper surfaces of the lower ends of the c-shaped members to form the front edge. Support bars secure between adjacent c-shaped members and openings are provided in the c-shaped members to reduce weight while maintaining strength.

2 Claims, 6 Drawing Sheets

MACHINE TO UNLOAD TIES OFF OF RAILROAD CARS

BACKGROUND OF THE INVENTION

1. Field of the Invention

The present invention relates to a machine to unload ties off of railroad cars. More specifically the present invention is an attachment for use with a backhoe or track hoe that enables the backhoe or track hoe to more efficiently function in unloading railroad ties from open top, gondola type railroad cars.

2. Description of the Related Art

The normal procedure for unloading railroad ties from a series of open top, gondola type railroad cars employs material handlers that sit on the top of the railroad cars and unload the ties along the railroad track as the cars are pulled slowly down the railroad track. These material handlers are normally either a backhoe or track hoe that employs a grapple attachment on the arm of the backhoe or track hoe.

When unloading ties from railroad cars, the backhoe or track hoe will first be loaded onto the last or rear car of the series of gondola type railroad cars which contain the railroad ties. A ramp is normally removably positioned at the rear end of the last car so that the backhoe or track hoe can climb up the ramp and onto the top of the ties located in the rear car. When so loaded onto the car, the backhoe or track hoe will be positioned on the top of the railroad ties that are contained in the cars and from this position can lift the ties out of the cars and place the ties on the ground beside the cars on either side of the railroad track.

To unload a series of cars, the backhoe or track hoe will first be driven onto the cars via the ramp positioned at the rear of the last car and then driven over the tops of the loaded cars until the backhoe or track hoe rests on the rear portion of the front car of the series of cars. The front end of the first car will then be unloaded by employing a grapple attachment which was attached to the arm of the backhoe or track hoe before the backhoe or track hoe was driven onto the cars. Then the backhoe or track hoe will then be moved rearward so that it rests partly on the front car and partly on the second car of the series. After more ties are unloaded from the first car using the grapple, the backhoe or track hoe is then moved rearward so that it rests entirely on the second car. From this position, the first car can be completely unloaded employing the present invention.

This process of unloading cars continues until all but the last car is unloaded. Because the backhoe or track hoe rests on the ties of the last car, only the front part of that last car can be unloaded until the backhoe or track hoe is allowed to dismount off of the last car via the same ramp that was used for loading the backhoe or track hoe onto the cars initially. With the backhoe or track hoe sitting on the ramp, the remaining ties located in the rear of the last car can be unloaded by using the grapple.

The grapples used for this purpose consist of opposing jaws that clamp around the railroad ties to secure them to the arm of the backhoe or track hoe while the ties are being lifted out of the car and dropped onto the ground. These grapples are difficult to use for several reasons.

First, because of the free swinging swivels and rotary action of the grapple, it is hard to control. This requires an operator to take more time getting into position to pick up ties, causing unnecessary delays in unloading cars. The grapple can slip over the ties, resulting in missed pickups and requiring a second attempt to re-pick the ties. Difficulty in operating the grapple translates into longer learning time for new operators, longer unloading cycles for experienced operators, and increased operator fatigue. Even using the best grapples currently available on the market, the average number of ties that can be unloaded from a railroad car is only approximately 600 to 1000 ties per hour.

Additionally, the grapple does not permit the operator to accurately control the placement of the ties on the ground since the ties simply fall out of the grapple when the jaws are opened. Inability to accurately place ties is particularly problematic on steep banks and slopes where ties can slip down the bank or slope and be lost. Still a further problem with use of grapples is that the operator can not control the number of ties that are dropped from the grapple since when the jaws of the grapple are opened, the entire load of ties are free to drop out of the grapple.

Further, because of the difficulty in quickly moving the ties from the car to the ground beside the railroad track, the proper number of ties can not always be placed where they are needed on the side of the tracks since placement is done as the train is moving down the tracks.

Another disadvantage with a grapple is that inserting two opposing jaws of the grapple into a full car load of railroad ties is difficult. The jaws of the grapple can easily damage the ties as downward pressure is placed on the grapple in order to insert the jaws of the grapple between ties.

Still further, because there are several pointed teeth associated with the jaws, these teeth can become caught in holes that are frequently found in the bottom of the railroad cars in which the ties are loaded.

Another problem with use of grapples in unloading ties is that the operator must engage the ties located at the rear of the car without being able to see the ties. This is difficult with a grapple since the operator can not see where the jaws of the grapple are being placed relative to the ties because the back wall of the car blocks the operator's view.

Still a further disadvantage with use of a grapple is that when ties are dropped inside the car, they tend to scatter and the grapple is not an effective tool for chasing and gathering the scattered ties back into a pile so that the grapple can grasp them.

Another disadvantage with using a grapple is that the grapple has free swinging swivels, hydraulic hose and fittings, and hydraulic motor which add to the maintenance, and down time caused by repair or replacement of broken hoses, fittings, parts, and hydraulic oil.

The present invention addresses each of these problems. First, the present invention has no free swinging swivels and rotary action and therefore is easy to control. This enables an operator to more quickly and easily pick up ties and unload cars. The present invention inserts under the ties and picks them up in a simple scooping action, thereby eliminating slippage and missed pickups. Easier operation of the present invention translates into shorter learning time for new operators, shorter unloading cycles for experienced operators, and decreased operator fatigue. Employing the present invention, the average number of ties that can be unloaded from a railroad car can be increased from the norm of 600 to 1000 ties per hour with a grapple to approximately 800 to 2,400 ties per hour.

The present invention permits the operator to accurately control the placement of the ties on the ground. The ties can be place perpendicular or parallel to the track with the present invention and in a neat, orderly, and consistent manner. By employing the present invention, there is less loss of ties down steep banks and slopes because of more controlled placement possible with the present invention. Another advantage with the present invention is that because ties slide off of the end of the device when the device is tilted forward or downward in order to unload them, the operator can control the number of ties that are dropped from the present device simply by controlling the amount of tilt of the device.

Because ties can be quickly moved from the car to the ground beside the railroad track with the present invention, the proper number of ties can be reliably placed where they are needed on the side of the tracks as the train is moving down the tracks.

And because the present invention has only one edge to insert between the ties, inserting of the present invention into a full car load of railroad ties is easy and can be done with a minimum of damage to the ties.

Further, because there is only one edge on the present invention, there is less likelihood that it will be caught in holes that are present in the bottom on the railroad cars.

Although the operator must engage the ties located at the rear of the car without being able to see the ties, because of the scooping action of the present invention toward the operator, it is relatively easy to remove all ties from a car simply by placing the edge of the present invention on the bottom of the car and moving it along the bottom of the car toward the rear wall of the car and then lifting the ties upward in the device.

By using the present invention, fewer ties are dropped inside the car and when they are dropped, they do not scatter because of the backward scooping action of the present invention. Also, for those few ties that are dropped inside the car, the present invention serves as an effective tool to pull them back into approximately perpendicular position relative to the side walls of the car so that they can then be in the proper position to be loaded onto the device.

The present invention does not have free swinging swivels, hydraulic hose and fittings, and a hydraulic motor. Therefore, it requires less maintenance cost and less down time.

SUMMARY OF THE INVENTION

The present invention is an attachment used in conjunction with a backhoe or track hoe to convert the backhoe or track hoe into a machine to unload ties off of railroad cars. More specifically, the attachment secures to the distal end of the working arm of a backhoe or track hoe so that a front edge of the attachment is oriented toward the backhoe or track hoe. With the backhoe or track hoe positioned on top of the ties that are in the gondola type railroad car, the front edge of the attachment can then be inserted between the ties. The front edge is pushed downward and tilted to pull it toward the backhoe or track hoe, thereby tilting the front edge upward to capture a load of ties onto the attachment. The attachment is then lifted up out of the railroad car and over the side of the car to deliver the load of ties onto the side of the railroad track.

The upper end of the attachment is provided with two pins for securing the attachment to the distal end of the working arm. When thus secured to the arm, the arm can be used to move the attachment up, down, forward, backward, and from side to side. One of the two pins of the attachment is secured to a stationary part of the working arm and the other pin of the attachment is secured to a movable part of the working arm. Thus, by moving the movable part of the working arm relative to the stationary part of the working arm, this allows the operator to tilt the attachment forward and backward. When the attachment is tilted forward or downward, the front edge of the attachment is pointing downward and in this position can be used to insert the attachment into a stack of ties or alternately to unload a load of ties from the attachment. The attachment is tilted backward or upward in the process of loading ties onto the attachment. Ties are loaded onto the attachment by a backward sweeping and lifting motion of the attachment by the arm of the backhoe or track hoe. To unload ties from the attachment, the arm of the backhoe or track hoe is employed to position the ties in the desired location beside the railroad track and then tilt the attachment forward to allow part or all the load of ties to slip off of the front edge of attachment.

The upper end of the attachment is provided with an upper plate to which upper ends of each of four c-shaped members are attached. An opposite lower end of each of the four c-shaped members is flattened on its upper and lower surfaces into a pointed end. A lower plate is secured to the upper surfaces of the lower ends of the four c-shaped members to form a pointed front edge on the attachment. The four c-shaped members are spaced apart from each other and are provided with bars secured between adjacent c-shaped members to hold them in a spaced apart relationship, thereby making the c-shaped members strong and rigid while minimizing the weight of the attachment. Each c-shaped member is preferably provided with openings along its length to further reduce the weight of the attachment without compromising its strength.

The attachment is a unitary device with no moving parts other than the two pins that secure it to the arm of the backhoe or track hoe. The arm of the backhoe or track hoe moves the attachment as a unit forward, backward, up, down, and sideways and tilts the attachment as a unit forward and backward.

DETAILED DESCRIPTION OF THE PREFERRED EMBODIMENT

Figure 1:
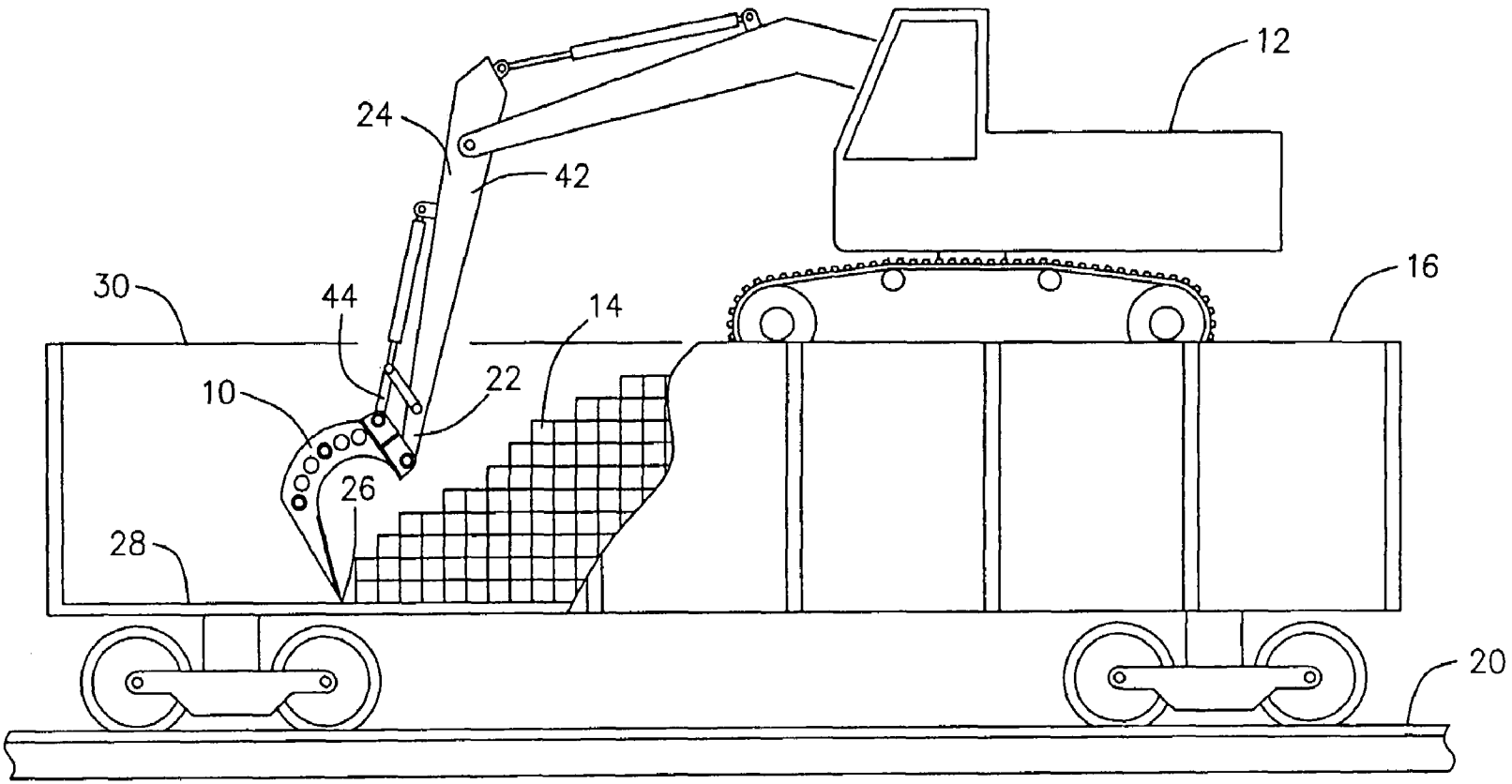
FIG. 1 is an enlarged side view of a machine consisting of a track hoe with an attachment constructed in accordance with a preferred embodiment of the present invention. The track hoe is illustrated resting on top of a railroad car loaded with railroad ties and with the attachment being lowered into the railroad car in preparation for loading ties onto the attachment.

Referring now to the drawings and initially to FIGS. 1-4, there is illustrated an attachment 10 constructed in accordance with a preferred embodiment of the present invention that is used in conjunction with a backhoe or track hoe 12 to convert the backhoe or track hoe 12 into a machine to unload railroad ties 14 off of railroad cars 16. Although the illustrations show the attachment 10 in use only with a track hoe 12, the invention is not so limited and it may alternately be employed with a backhoe or other suitable type of equipment. Hereafter the equipment with which the attachment 10 is employed will be referred to as a track hoe 12 to correspond to the accompanying illustrations.

FIGS. 1-4 show sequentially how the attachment 10 is employed to unload ties 14 out of a railroad car 16 onto the attachment 10 and then unload the ties 14 off of the attachment 10 at the desired location on the ground 18 beside the railroad track 20.

Figure 2:
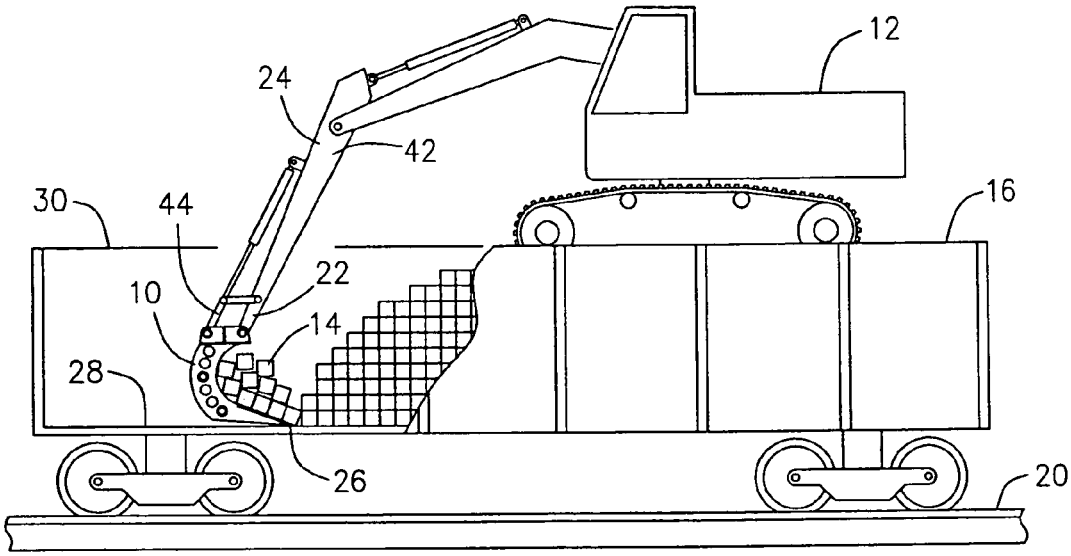
FIG. 2 is a side view of the machine for unloading ties off of railroad cars illustrated in FIG. 1 shown with the attachment being pulled under the ties that are contained in the railroad car.
Figure 3:
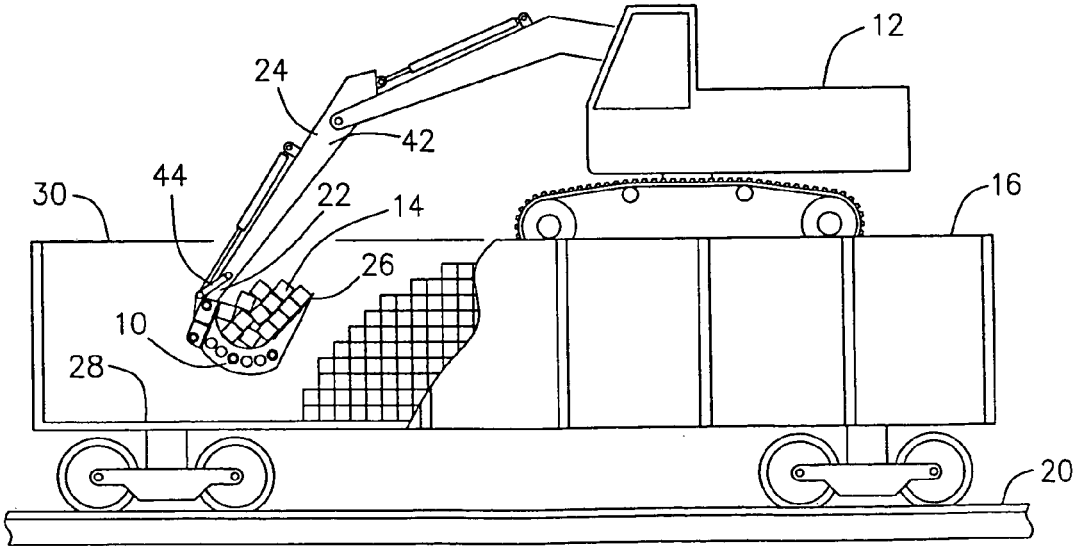
FIG. 3 is a side view of the machine for unloading ties off of railroad cars illustrated in FIGS. 1 and 2 shown with the front edge of attachment being tilted backward or upward to load ties onto the attachment.
Figure 4:
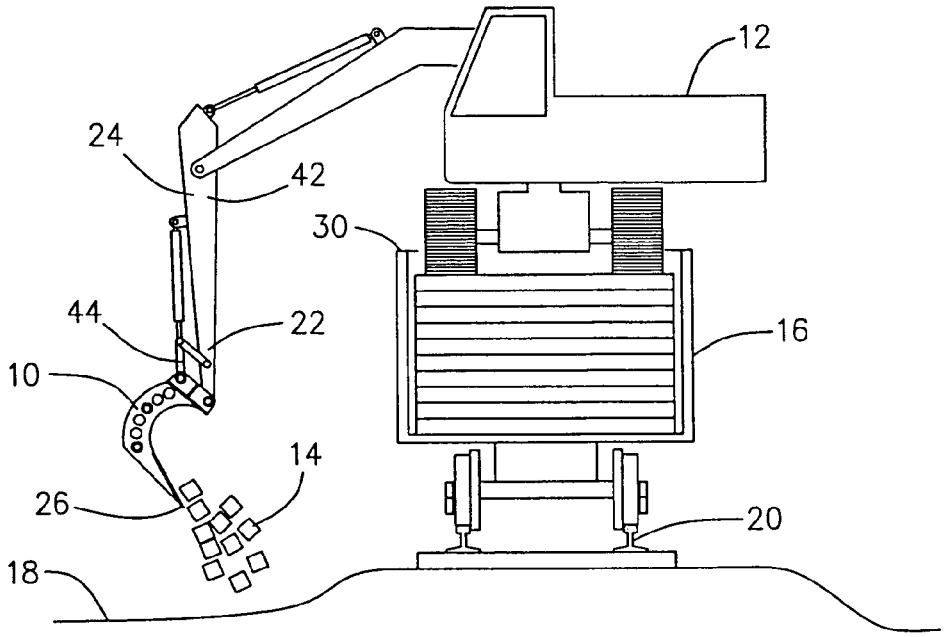
FIG. 4 is a front view of the machine for unloading ties off of railroad cars illustrated in FIGS. 1-3 shown with the arm positioning the attachment beside the railroad tracks where the ties are to be unloaded and tilting the attachment forward to unload the ties onto the ground.

As illustrated in FIG. 1, the attachment 10 secures to a distal end 22 of the working arm 24 of a track hoe 12 so that a front edge 26 of the attachment 10 is oriented toward the track hoe 12. Then with the track hoe 12 positioned on top of the ties 14 that are in the gondola type railroad car 16, the front edge 26 of the attachment 10 can then be inserted between the ties 14. The front edge 26 is first tilted downward away from the track hoe 12 then pushed downward to the bottom 28 of the railcar 16, as shown in FIG. 1. Next, the front edge 26 is pulled toward the track hoe 12 to move the attachment 10 under the ties 14, as shown in FIG. 2. The front edge 26 is then tilted backward and upward to capture a load of ties 14 onto the attachment 10 as the entire attachment 10 is moved upward by the working arm 24, as shown in FIG. 3. The attachment 10 is then lifted upward and over the side wall 30 of the car 16 to deliver the load of ties 14 onto the ground 18 beside the railroad track 20, as shown in FIG. 4.

Figure 5:
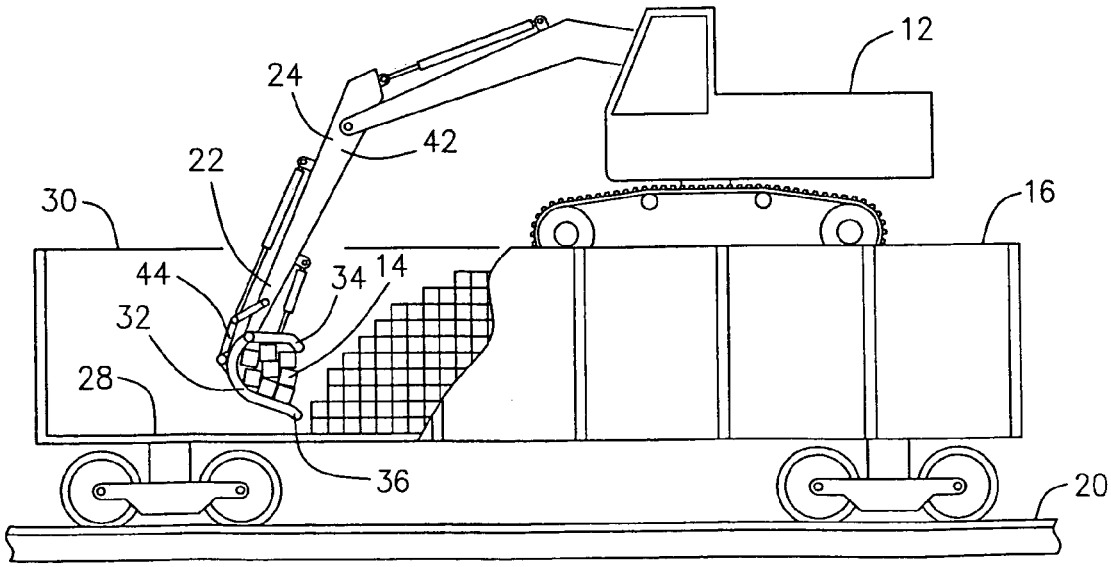
Fig. 5 (Prior Art)
FIG. 5 is a side view of a prior art machine for unloading ties off of railroad cars showing a track hoe with attached grapple that is used to grasp ties.
Figure 6:
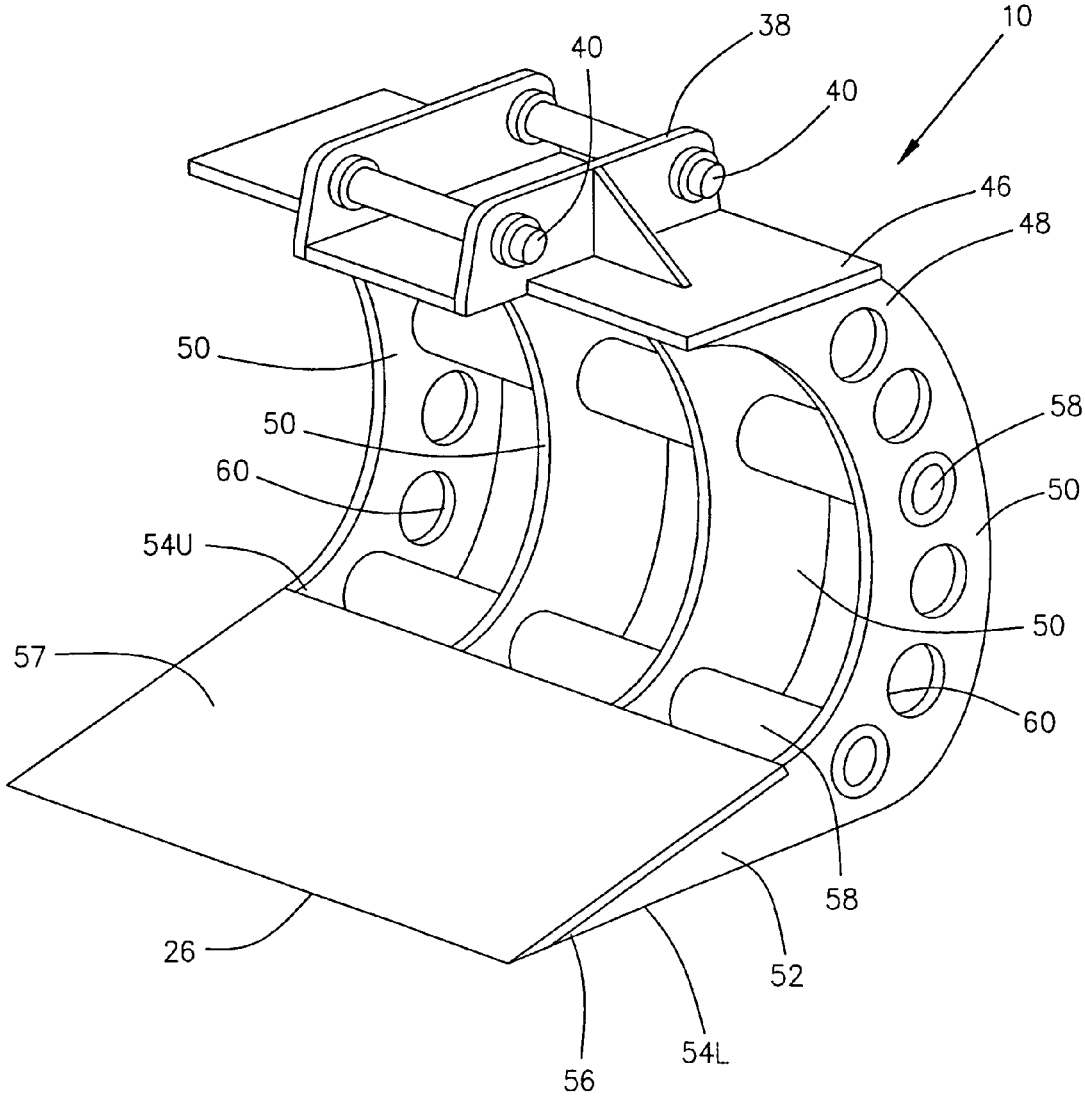
FIG. 6 is an enlarged perspective view of the attachment illustrated in FIGS. 1-4.
Figure 7:
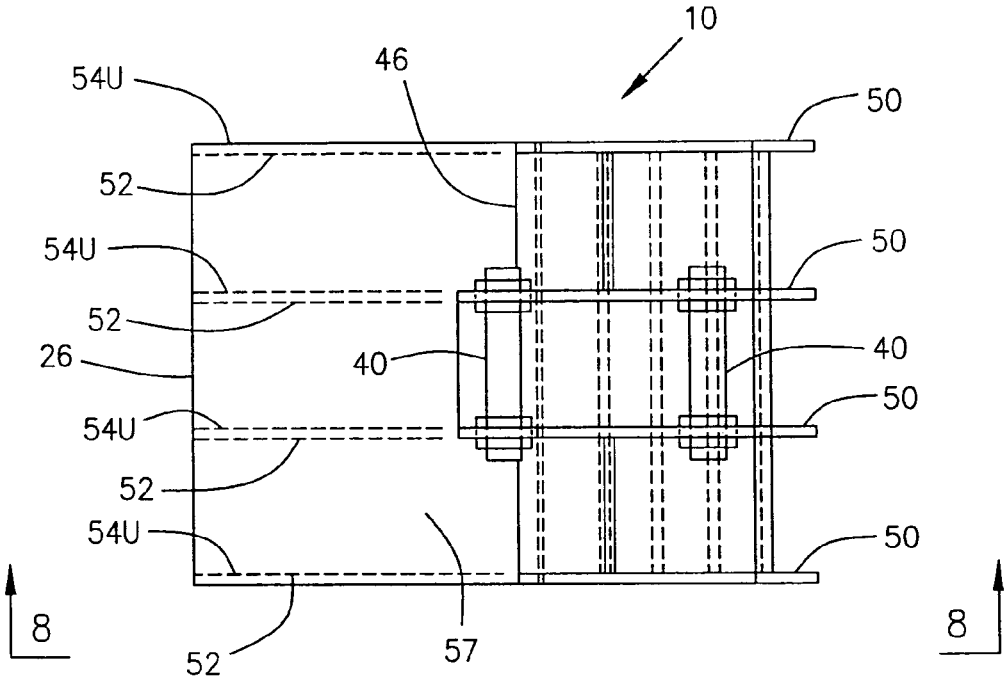
FIG. 7 is a top plan view of the attachment of FIG. 6.
Figure 8:
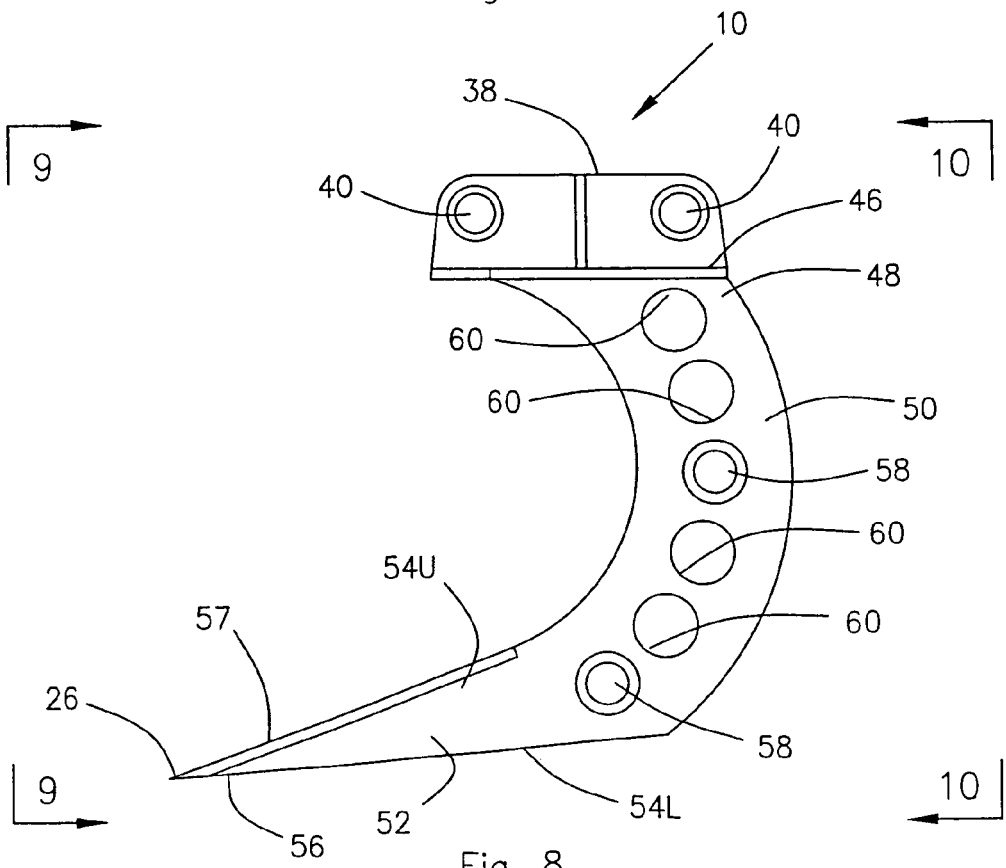
FIG. 8 is a left side view of the attachment taken along line 8-8 of FIG. 7.
Figure 9:
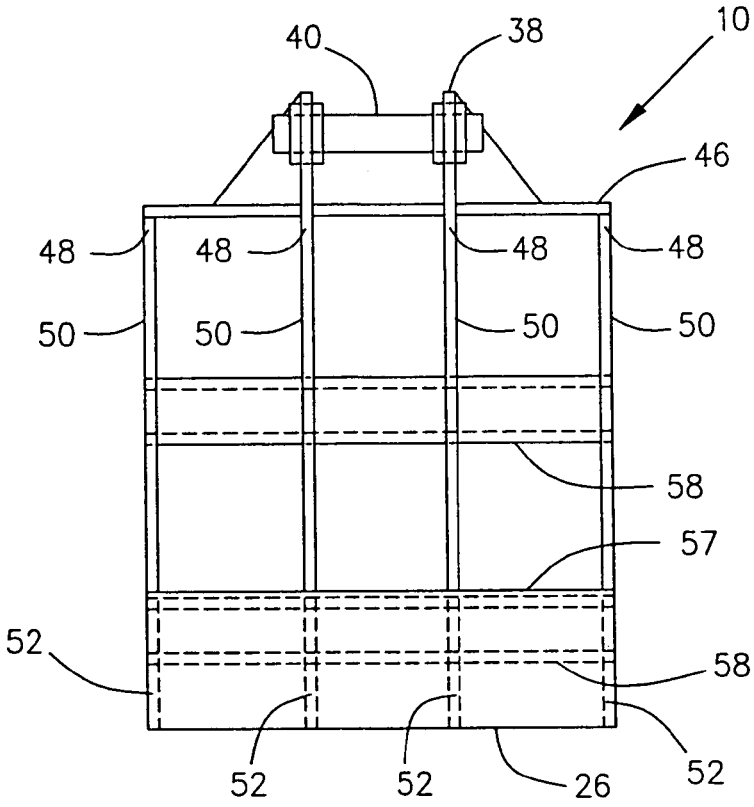
FIG. 9 is a front view of the attachment taken along line 9-9 of FIG. 8.
Figure 10:
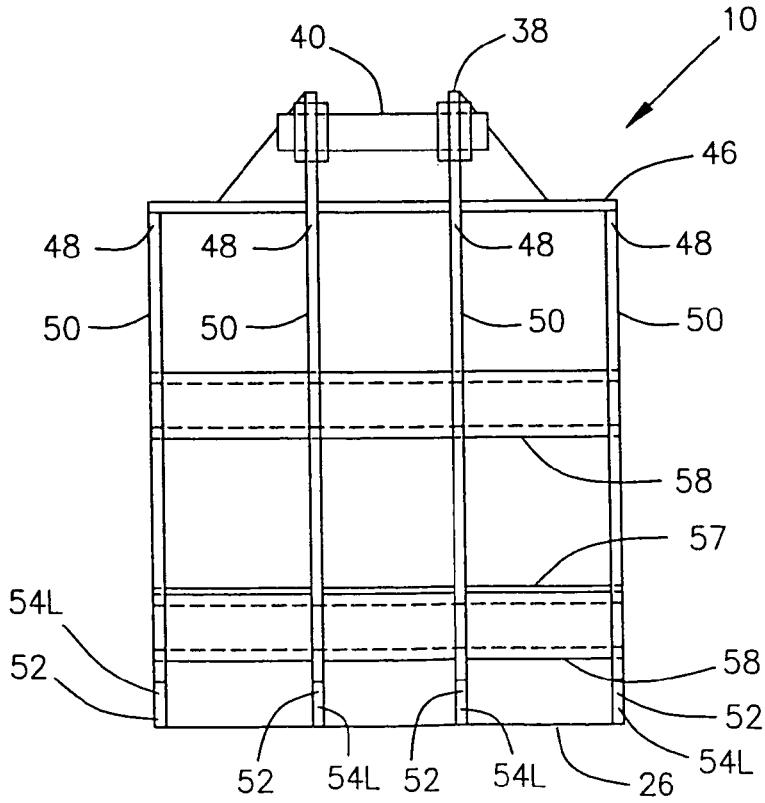
FIG. 10 is a rear view of the attachment taken along line 10-10 of FIG. 9.

FIG. 5 illustrates the prior art grapple attachment 32 currently being used on equipment such as track hoes 12 to unload ties 14 from railroad cars 16. The prior art grapple 32 has to insert two pairs of teeth, a top pair of teeth 34 and a bottom pair of teeth 36 into the pile of ties 14 and then must move the two pair of teeth 34 and 36 together to grip a load of ties 14. The operation of the prior art grapple attachment 32 is much more complicated than the operation illustrated and described above for the attachment 10 which employs only one front edge 26 that inserts under the ties 14 and employs gravity to hold the ties 14 on the attachment 10 as it is lifted out of the railroad car 16.

Referring now to FIGS. 6-10, the detailed construction of the present attachment 10 is illustrated. An upper end 38 of the attachment 10 is provided with two pins 40 for securing the attachment 10 to the distal end 22 of the working arm 24. When thus secured to the arm 24, the arm 24 can be used to move the attachment 10 upward, downward, forward, backward, and from side to side.

Referring also to FIG. 1, one of the two pins 40 of the attachment 10 is secured to a stationary part 42 of the working arm 24 of the track hoe 12 and the other pin 40 is secured to a movable part 44 of the working arm 24 of the track hoe 12. Thus, by moving the movable part 44 of the working arm 24 relative to the stationary part 42 of the working arm 24, this allows the operator to tilt the attachment 10 forward and downward, as illustrated in FIGS. 1 and 4, and allows the operator to tilt the attachment 10 backward and upward, as illustrated in FIGS. 2 and 3.

When the attachment 10 is tilted forward or downward, the front edge 26 of the attachment 10 is pointing downward. In this position, the front edge 26 can be used to insert the attachment 10 into a stack of ties 14, or alternately, to unload a load of ties 14 from the attachment 10. To unload ties 14 from the attachment 10, the arm 24 of the track hoe 12 is employed to position the ties 14 in the desired location beside the railroad track 20 and then to tilt the attachment 10 forward to allow part or all the load of ties 14 to slip off of the front edge 26 of the attachment 10 onto the ground 18.

The attachment 10 is tilted backward or upward in the process of loading ties 14 onto the attachment 10. Ties 14 are loaded onto the attachment 10 by a backward sweeping and lifting motion of the attachment 10 caused by the appropriate movement of the arm 24 of the track hoe 12.

The upper end 38 of the attachment 10 is provided with an upper plate 46 to which upper ends 48 of each of four c-shaped members 50 are attached. An opposite lower end 52 of each of the four c-shaped members 50 is flattened on its upper and lower surfaces 54U and 54L to form a pointed lower tip 56. A lower plate 57 is secured to the upper surfaces 54U of the lower pointed tips of the four c-shaped members 50 to form a pointed front edge 26 on the attachment 10.

The four c-shaped members 50 are spaced apart from each other and are provided with support bars 58 secured between adjacent c-shaped members 50 to hold them in a spaced apart relationship, thereby making the c-shaped members 50 strong and rigid while minimizing the weight of the attachment 10. Also although not illustrated, because the c-shaped members 50 are spaced apart, debris associated with the ties 14 can fall out of the ties 14 and between the c-shaped members 50 as the ties 14 are lifted. The debris falls back onto the bottom 28 of the cars 16 resulting in less debris being transferred to the ground 18 with the ties 14 as they are unloaded. Each c-shaped member 50 is also preferably provided with openings 60 along its length to further reduce the weight of the attachment 10 without compromising its strength.

The attachment 10 is a unitary device with no moving parts other than the two pins 40 that secure it to the arm 24 of the track hoe 12. As shown in the illustrations, the arm 24 of the track hoe 12 moves the attachment 10 as a unit forward, backward, upward, downward, and sideways and tilts the attachment 10 as a unit forward and downward or backward and upward.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A tool for attaching to the hydraulic arm of a backhoe or trackhoe machine for unloading ties from a railroad car comprising:

an upper plate having a first side and a second side;

means for attaching the tool to the hydraulic arm on the first side of the upper plate;

a plurality of substantially c-shaped tines having upper and lower ends, wherein the tines are connected at the upper ends to the second side of the upper plate, wherein the tines have upper and lower surfaces and wherein the upper and lower surfaces are flattened near the lower ends such that the tines taper to a point at their lower ends; and a lower plate connected to the tines along the upper surfaces of the lower ends of the tines to form a pointed front edge;

wherein the lower surface of the lower end of each tine forms substantially straight edge that is generally parallel to the upper plate so that the tool has a flat lower edge that is useful for sliding the tool along the floor of the railroad car when the front edge is pointed toward the machine and useful for sliding the tool along a wall of the railroad car when the front edge is pointed downward;

wherein the upper surface of the lower end of each tine is substantially smooth so that ties can slip off the tool when the front edge is pointed somewhat downward;

wherein the substantially c-shaped tines form a deep pocket with unobstructed sides when the front edge is pointed upward so that the tool can hold ties.

2. An attachment for a hydraulic arm of a backhoe or trackhoe machine, the attachment comprising:

an upper plate having a first side and a second side, wherein the first side is connected to the hydraulic arm;

a plurality of tines, wherein each of the plurality of tines comprises:

a proximal portion connected to the second side of the upper plate, wherein the proximal portion includes an interior surface and an exterior surface, and wherein the curvature of the interior and exterior surfaces of the proximal portion of each of plurality of tines is substantially c-shaped; and a distal portion connected to the proximal portion, wherein the distal portion includes a linear outer surface extending from the exterior surface of the proximal portion to a distal end; and a linear inner surface extending from the interior surface of the proximal portion to the distal end; and a lower plate attached to the linear inner surface of the distal portions of the plurality of tines.

* * * * *